US011209232B2

(12) United States Patent
Kirstein

(10) Patent No.: US 11,209,232 B2
(45) Date of Patent: Dec. 28, 2021

(54) SEMI-AUTOMATIC OR FULLY AUTOMATIC FIREARM

(71) Applicant: Gerhard Kirstein, Augsburg (DE)

(72) Inventor: Gerhard Kirstein, Augsburg (DE)

( * ) Notice: Subject to any disclaimer, the term of this patent is extended or adjusted under 35 U.S.C. 154(b) by 0 days.

(21) Appl. No.: 16/747,053

(22) Filed: Jan. 20, 2020

(65) Prior Publication Data

US 2020/0232739 A1 Jul. 23, 2020

(30) Foreign Application Priority Data

Jan. 18, 2019 (DE) ..... 10 2019 000 301.2

(51) Int. Cl.
*F41A 19/27* (2006.01)
*F41A 3/10* (2006.01)
(Continued)

(52) U.S. Cl.
CPC ..... *F41A 19/27* (2013.01); *F41A 3/10* (2013.01); *F41A 3/68* (2013.01); *F41A 19/13* (2013.01)

(58) Field of Classification Search
CPC ..... F41A 3/00; F41A 3/12; F41A 3/36; F41A 3/44; F41A 3/64; F41A 19/59; F41A 19/27; F41B 11/71
See application file for complete search history.

(56) References Cited

U.S. PATENT DOCUMENTS 2,380,455 A * 7/1945 Lippert ..... F41A 17/14 89/135
3,241,445 A * 3/1966 Janssen ..... F41A 19/37 89/28.05
(Continued)

FOREIGN PATENT DOCUMENTS

CN 209820252 U * 12/2019
DE 10 2006 006 939 A1 8/2007
RU 2148229 C1 * 4/2000

OTHER PUBLICATIONS

Office Action dated Nov. 29, 2019 in corresponding German Patent Application No. 10 2019 000 301.2.

*Primary Examiner* — Benjamin P Lee
(74) *Attorney, Agent, or Firm* — Ostrolenk Faber LLP

(57) ABSTRACT

A semi-automatic or fully automatic firearm (2) having a barrel (4), the rear end of which is in the form of a cartridge chamber (8), in which each round can be inserted from the rear; a breech body (6) that is movable in a longitudinal direction of the barrel between an open position for releasing the cartridge chamber (8) for reloading a round and a locking position that locks the cartridge chamber (8), wherein in the locking position the breech body (6) closes the cartridge chamber (8) at the rear and the cartridge casing acts as a thrust bearing, wherein the firearm (2) has a breech body locking device (20) that is designed to move a breech body lock from a breech body release position for releasing the breech body (6) to a breech body locking position for locking the breech body (6) and from the breech body locking position to the breech body release position, wherein the breech body locking device (20) has an electromagnet (24) for moving the breech body lock from the breech body release position to the breech body locking position, and/or an electromagnet (24) for moving the breech body lock from the breech body locking position to the breech body release position, as well as a firearm (2) with an electromagnetically driven firing pin (18).

14 Claims, 4 Drawing Sheets

(51) Int. Cl.
*F41A 3/68* (2006.01)
*F41A 19/13* (2006.01)

(56) References Cited

U.S. PATENT DOCUMENTS

| | | | | | |
|---|---|---|---|---|---|
| 4,232,583 | A * | 11/1980 | Harrison | F41A 3/44 | 89/153 |
| 4,739,571 | A * | 4/1988 | Brint | F41A 3/12 | 42/16 |
| 6,401,592 | B1 | 6/2002 | Rostocil | 89/33.16 | |
| 7,624,727 | B2 * | 12/2009 | Campo | F41B 11/71 | 124/77 |
| 8,042,296 | B1 * | 10/2011 | Kirstein | F41A 3/70 | 42/16 |
| 2004/0069138 | A1 * | 4/2004 | Jebsen | F41A 3/56 | 89/198 |
| 2016/0341514 | A1 * | 11/2016 | Grace | H02K 5/02 | |
| 2018/0045485 | A1 | 2/2018 | Couce | | |
| 2019/0137202 | A1 | 5/2019 | Facchini et al. | | |
| 2020/0132412 | A1 * | 4/2020 | Pedicini | F41B 11/64 | |

* cited by examiner

SEMI-AUTOMATIC OR FULLY AUTOMATIC FIREARM

CROSS-REFERENCE TO A RELATED APPLICATION

The present application claims priority to German Patent Application No. 10 2019 000 301.2, filed Jan. 18, 2019, the content of which is incorporated by reference herein.

TECHNICAL FIELD

The invention relates to a semi-automatic or fully automatic firearm.

BACKGROUND OF THE INVENTION

Firearms with a locked breech and firearms with an unlocked breech are known from the prior art. In the area of firearms with locked breeches, various locking systems are known, for example combs on a barrel of the weapon and corresponding grooves in a carriage of the weapon or even a breech block on the end of the barrel, locking in the ejection port of the carriage. Other components of the firearms as claimed in the state of the art also have a somewhat complicated mechanical construction, which is expensive and prone to malfunctions.

SUMMARY OF THE INVENTION

Based on the prior art explained above, it is the object of the present invention to specify a firearm that allows a simple and cost-effective construction.

The object of the present invention is thus achieved by a semi-automatic or fully automatic firearm, which has the following: a barrel, the rear end of which is embodied as a cartridge chamber, in which a round can be inserted from the rear, a breech body that is movable in the longitudinal direction of the barrel between an open position for releasing the cartridge chamber for the reloading of a round and a closing position for closing the cartridge chamber, wherein in the closing position the breech body closes the cartridge chamber to the rear and acts as a thrust bearing for the cartridge sleeve. The firearm comprises a breech locking device, which is designed to move a breech body lock from a breech body release position for releasing the breech body into a breech body locking position for locking the breech body in its closing position and from the breech body locking position to the breech body release position. The breech locking device comprises an electromagnet for moving the breech body lock from the breech body release position to the breech body locking position, or comprises an electromagnet for moving the breech body lock from the breech body locking position to the breech body release position, or has an electromagnet for moving the breech body lock from the breech body locking position to the breech body release position and for moving the breech body lock from the breech body release position to the breech body locking position.

This means that the breech locking device has an electromagnet that may be designed to move the breech body lock by generating a magnetic field and a resulting force acting on the breech body lock to the breech body locking position in which the breech body is locked by the lock. In addition or alternatively, for this purpose the electromagnet is designed to move the breech body lock by generating a magnetic field and a resulting force that acts on the breech body lock to move it to the breech body release position in which the breech body is released. This ensures effective actuation of the breech body lock or of a breech body locking element at the same time as a simple design.

As a solution to the object underlying the invention, reference should also be made to a firearm having a firing device having at least one electromagnet for at least partial actuation of the same. In particular, the firing device may have a firing pin that is moved by means of the electromagnet from a neutral position to a firing position. As an alternative to this or even additionally, the firing pin may be moved from the firing position to the neutral position by means of the electromagnet.

It should be noted at this point that the firearm with the firing device described above does not have to be a locked weapon, but may also be any other firearm.

BRIEF DESCRIPTION OF THE DRAWINGS

The invention is described below with reference to the enclosed drawings on the basis of possible embodiments as examples. In the figures.

DESCRIPTION OF PREFERRED EMBODIMENTS

Figure 1:
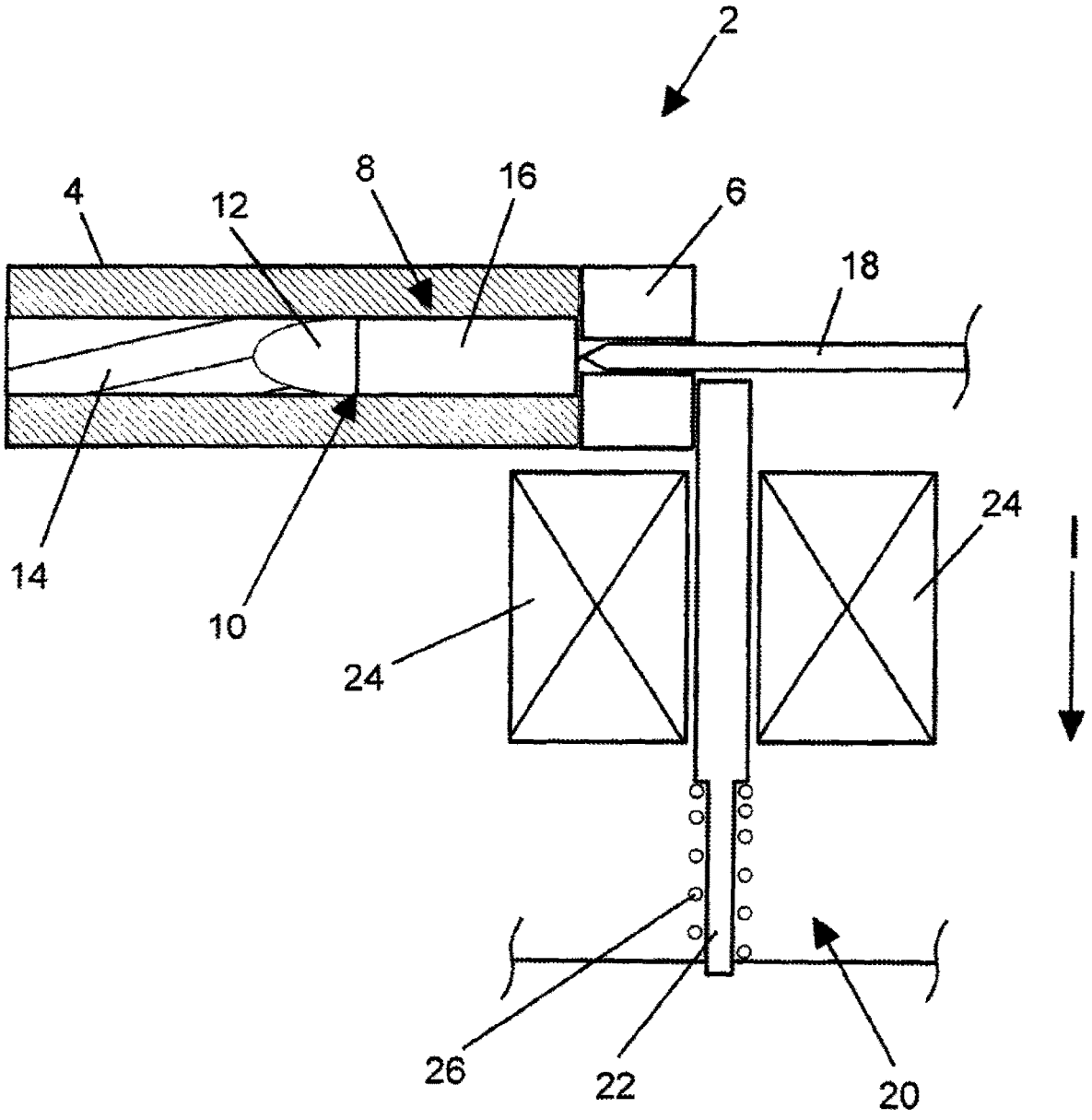
FIG. 1 shows a partial view (sectional view) of a first possible embodiment of a firearm according to the invention in a breech body locking position.
Figure 2:
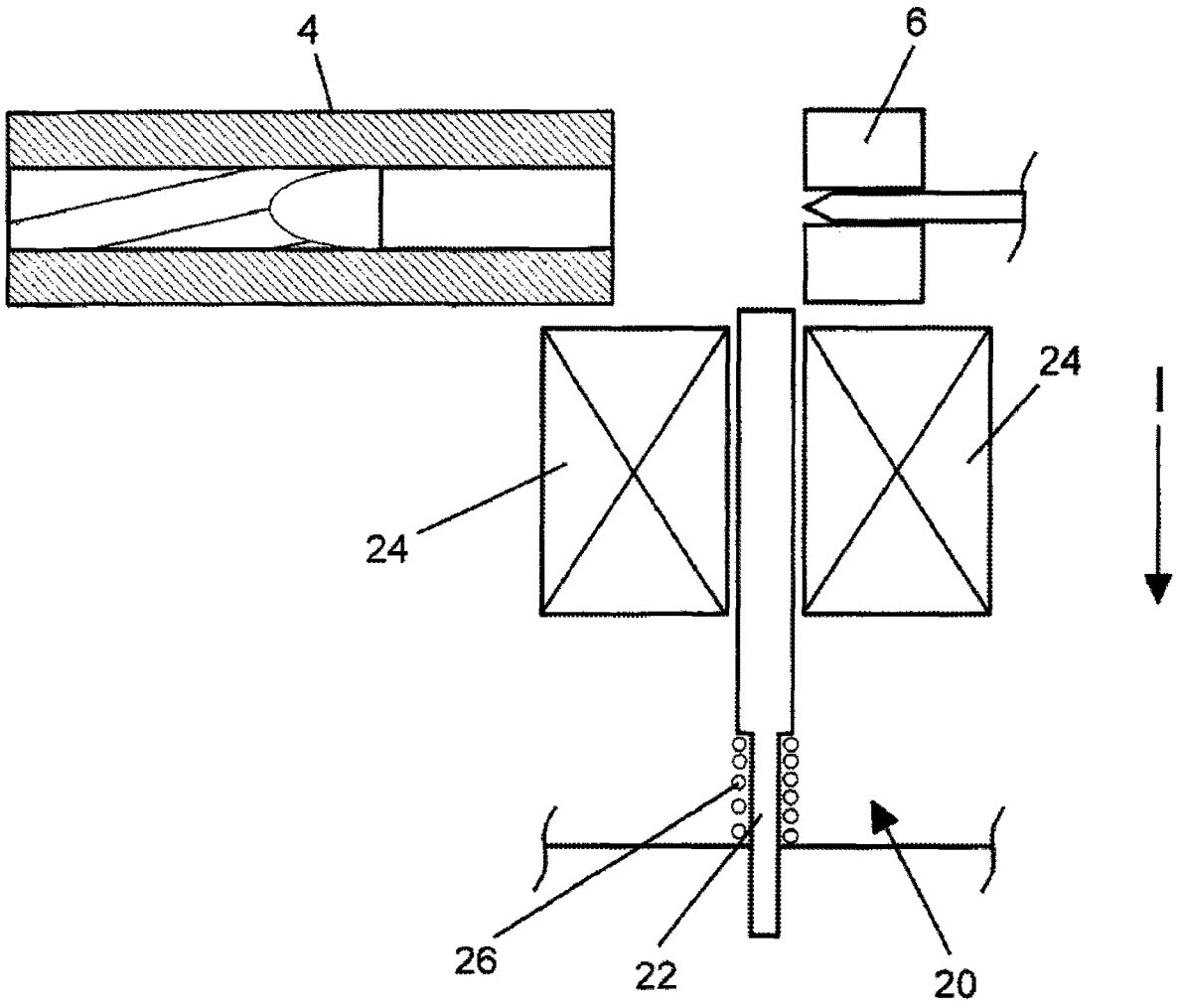
FIG. 2 shows a partial view (sectional view) of a first possible embodiment of a firearm according to the invention in a breech body release position.
Figure 3:
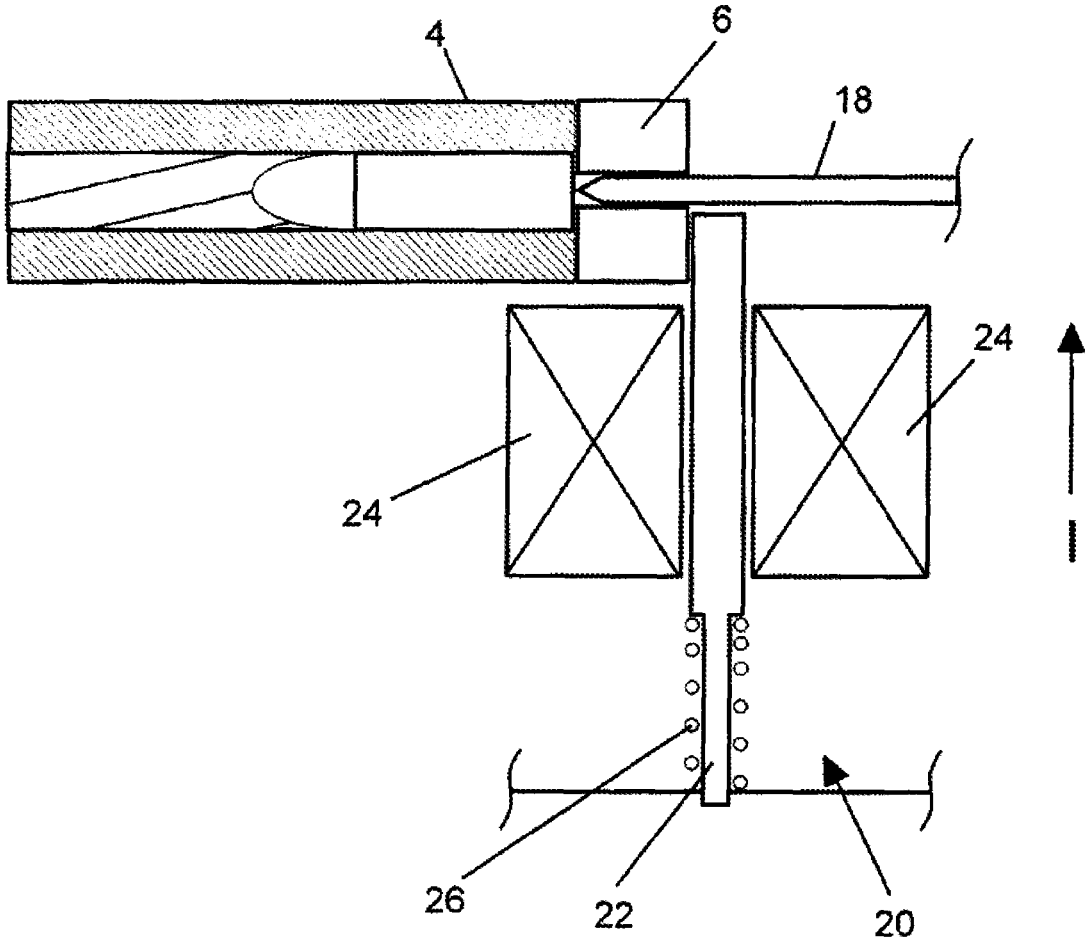
FIG. 3 shows a partial view (sectional view) of a second possible embodiment of a firearm according to the invention in a breech body locking position.

FIG. 1, FIG. 2 and FIG. 3 show a barrel 4 and a breech body 6 of a firearm 2 according to the invention. A rear section of the barrel 4 is designed as a cartridge chamber 8. The breech body 6 can be moved in a breech guide (not shown) in the longitudinal direction of the barrel 4 between the breech body locking position shown in FIG. 1 and the breech body release position shown in FIG. 2.

In the closing position shown in FIG. 1, the breech body 6 forms a thrust bearing for absorbing the recoil on the ignition of the (not shown) propellant charge of the cartridge 10. On the ignition of the propellant charge of the cartridge 10, the bullet 12 is driven through a bore 14 of the barrel 4, while a cartridge casing 16 is held in the cartridge chamber 8 by the breech body 6 against the pressure of the explosion of the propellant charge.

After firing, the breech body 6 is moved back to the open position shown in FIG. 2. The cartridge casing 16 is ejected during this, so that a new cartridge can then be automatically inserted into the cartridge chamber 8.

To ignite the propellant charge of the cartridge 10, a firing pin 18 strikes the center on the rear of the cartridge 10.

The firearm has a breech locking device 20 that is designed to move a breech body lock in the form of a locking bolt 22 from a breech body release position (in FIG. 2) for releasing the breech body 6 to a breech body locking position 6 (shown in FIG. 1 and FIG. 3) for locking the breech body in the closing position and from the breech body locking position to the breech body release position.

For this purpose, the breech locking device 20 in the embodiments described in FIG. 1 to FIG. 3 comprises an electromagnet 24 and an elastic element in the form of a spring 26, which has a working engagement with the locking bolt or engages the bolt in a force-locking manner or is connected to the bolt in a force-locking manner. The electromagnet is arranged in such a way that a magnetic field generated thereby acts on the locking bolt 22. In the embodiments described, a section of the locking bolt 22 is arranged within the electromagnet (somewhat like a coil core, but movable with respect to the magnet).

With the embodiment shown in FIG. 1 and FIG. 2, the spring 26 is formed as a coil compression spring that pushes the locking bolt 22 into the breech body locking position by means of the spring force thereof. If a position of the locking bolt 22 in the breech body locking position is desired, the electromagnet 24 is left in or set into a deenergized state and the spring force presses the locking bolt 22 into the breech body locking position.

If movement of the locking bolt 22 into the breech body release position is desired, the electromagnet 24 is energized, so that the locking bolt 22 is pulled into the breech body release position by the force acting thereon due to the resulting magnetic field and the breech body 6 is thus released.

With the embodiment shown in FIG. 3, the spring 26 is in the form of a coil pullback spring, which pulls the locking bolt 22 into the breech body release position by means of the spring force thereof. If a position of the locking bolt 22 in the breech body release position is desired, the electromagnet 24 is left in or set into a deenergized state and the spring force pulls the locking bolt 22 into the breech body release position.

If movement of the locking bolt 22 into the breech body locking position is desired, the electromagnet 24 is energized, so that the locking bolt 22 is pulled into the breech body locking position by the force acting on it due to the resulting magnetic field and thus locks the breech body 6.

Figure 4:
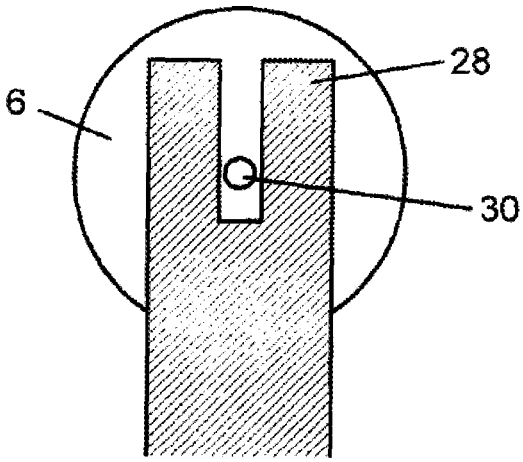
FIG. 4 shows a further partial view (sectional view) of an embodiment of a firearm according to the invention, the constructive details of which are realized in both the first and the second embodiments.

The locking bolt 22 has, besides the section that is arranged in the electromagnet 24, a locking section 28 that has a recess in which the firing pin 18 is arranged to move reciprocally in the longitudinal direction of the barrel. In the embodiment described in FIG. 4, the locking section is of an approximately U-shaped form in a plan view from behind of the breech body 6 of the firearm 2. This ensures that the firing pin 18 can hit the center on the rear of the cartridge 10 unhindered to ignite the propellant charge of the cartridge 10. This is shown in FIG. 4, from which it is also apparent that the breech body 6 has a cylindrical recess in the form of a bore 30, through which the firing pin 18 can pass and can ignite the propellant charge. Alternatively to this, the locking section may, for example, also comprise a bore or a different type of recess, in particular a bore corresponding to the bore 30 arranged in the breech body 6.

In an alternative embodiment, the spring 26 can be omitted. In this case, the electromagnet is used both for movement of the locking bolt 22 into the breech body locking position as well as for movement of the locking bolt 22 into the breech body release position. For this purpose, it is conceivable, for example, that the locking bolt has magnetic portions, which depending on the magnetic field direction are used for movement of the locking bolt 22 in the desired direction during an interaction with the magnetic field. In this case, the magnetic field direction can be reversed, for example, by a reversal of the current, which reverses the magnetic field of the electromagnet 24, which leads to opposite movements of the locking bolt 22. Alternatively, for example, the use of multiple electromagnets is conceivable, of which each electromagnet is provided for a movement of the locking bolt 22 in a different direction.

Figure 5:
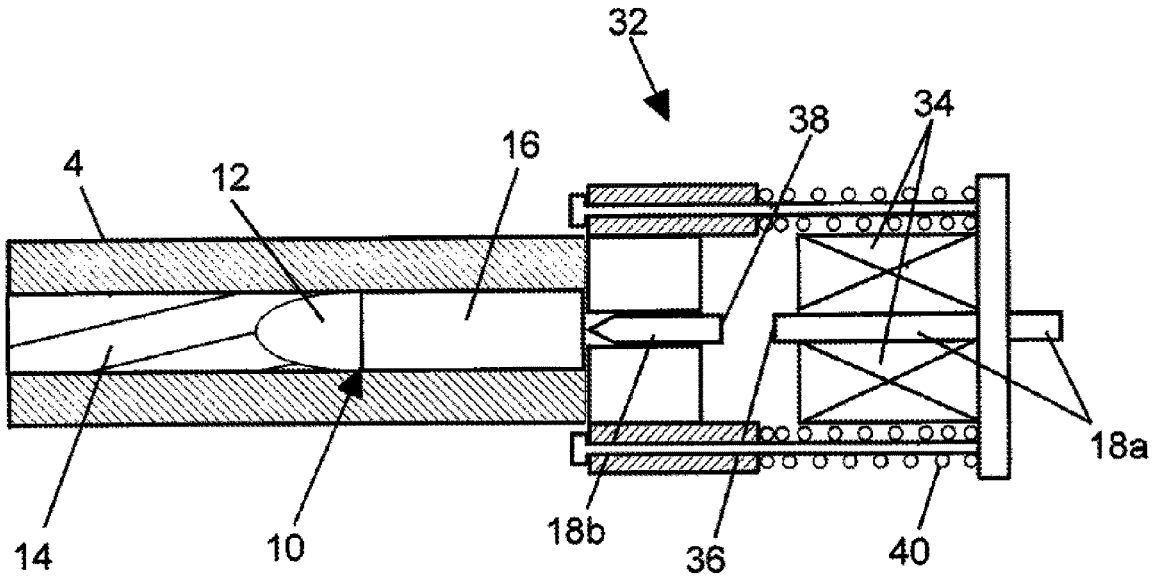
FIG. 5 shows a sectional view of a part of another possible embodiment of a firearm, which constitutes a firing device of the firearm.
Figure 6:
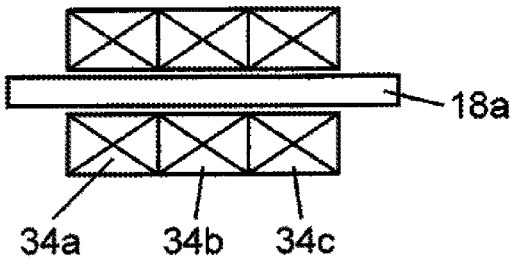
FIG. 6 shows a schematic view of an alternative embodiment to the embodiment of FIG. 5 of a firearm with a firing device with three electromagnets.

The firearm also comprises a firing device 32 that comprises another electromagnet 34 for at least partial actuation thereof in an embodiment described in FIG. 5 and FIG. 6. The firing device 32 further comprises the firing pin 18, which is of a two-piece form in the embodiment described in FIG. 5 and FIG. 6 and has a first firing pin section 18*a* and a second firing pin section 18*b*. Alternatively to this, the firing pin can also be in a one-piece form or a three-piece form or a multi-part form.

The first firing pin section 18*a* is arranged within the electromagnet 34 so as to be movable reciprocally in a longitudinal direction (again like a coil core, but movable) and is subjected to force by the field generated by the electromagnet due to its arrangement and can thus be moved by the action of the magnetic field. The second firing pin section 18*b* is arranged or supported in the breech body 6 so as to be movable reciprocally in the longitudinal direction.

The first firing pin section 18*a* can be moved by means of the force generated by the electromagnet 34 (when the electromagnet 34 is energized) from a neutral position (shown in FIG. 5) to a firing position, in which the first firing pin section 18*a* with an end face 36 facing towards the second firing pin section 18*b* meets an end face 38 of the second firing pin section 18*b* facing towards the first firing pin section 18*a* and, due to the kinetic energy thereof that is transmitted to the second firing pin section 18*b*, knocks the second firing pin section 18*b* towards the cartridge, which results in the ignition of the propellant charge.

The firing device 32 also comprises an elastic element in the form of a spring 40, which is in the form of a coil compression spring in the embodiment shown in FIG. 5 and which has a working engagement with or is connected in a force-locking manner to the first firing pin section 18*a* such that the spring force pushes the first firing pin section 18*a* into the neutral position.

Figure 7:
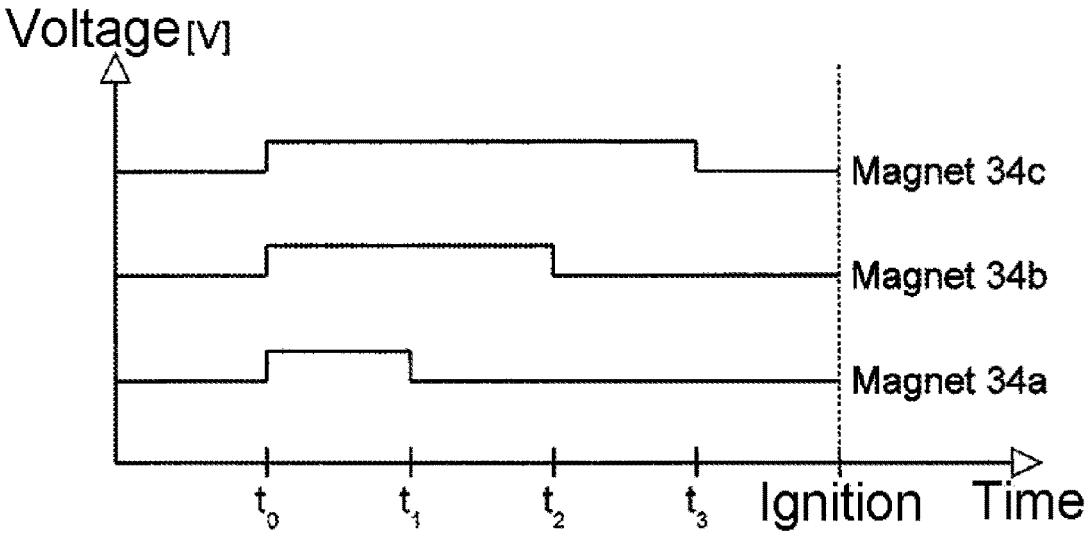
FIG. 7 shows a diagram showing a duty cycle of the electromagnets of the embodiment shown in FIG. 6.

In an alternative embodiment to this, the firing pin 18 (this in turn can be embodied in one piece or multiple pieces) can be moved by means of the electromagnet not only from the neutral position to a firing position but also from the firing position to the neutral position. For this purpose, in the embodiment shown in FIG. 6 there are three electromagnets 34*a*, 34*b* and 34*c*. The first firing pin section 18*a* (alternatively a section of the firing pin 18 in the case of a one-piece implementation of the firing pin) is arranged within the electromagnets 34*a*, 34*b* and 34*c*. By means of a time-varying energization of the individual electromagnets 34*a*, 34*b* and 34*c*, a movement of the first firing pin section 18*a* can be achieved either towards the neutral position or towards the firing position. By the time-varying energization, an acceleration in the desired direction of motion can also be achieved, for example an energization profile against time as shown in FIG. 7 is realized.

From the moment at which the firing is initiated (t0), all three electromagnets 34*a*, 34*b* and 34*c* are energized. At time t1, the first electromagnet 34*a* is switched to deenergized, from the time t2 the second electromagnet 34*b* is switched to deenergized and the third electromagnet 34*c* is switched to deenergized last at time t3. Here t1<t2<<t3 applies. The first electromagnet 34*a* is located furthest away from the cartridge 10 and the third electromagnet 34*c* is located closest to the cartridge 10, while the second electromagnet 34*b* is arranged in the middle between the other two. By this energization scheme, an acceleration of the first firing pin section 18*a* towards the firing position is achieved. Similarly, an acceleration in the other direction can also be produced by a correspondingly modified energization scheme.

Although the invention is described on the basis of embodiments with fixed combinations of features, it does however also include conceivable further advantageous combinations of features, as they are in particular but not exhaustively indicated by the subordinate claims. All disclosed

The invention claimed is:

1. A semi-automatic or fully automatic firearm having a barrel, the rear end of which is designed as a cartridge chamber, into which a round can be inserted from the rear, respectively;

a breech body, which is movable in a longitudinal direction of the barrel between an open position for releasing the cartridge chamber for the reloading of a round and a closing position that closes the cartridge chamber, wherein in the closing position the breech body closes the cartridge chamber to the rear and acts as a thrust bearing for a cartridge casing, wherein the firearm has a breech body lock that locks the breech body when the breech body is in the closing position, and a breech locking device that is designed to move the breech body lock from a breech body release position for releasing the breech body to a breech body locking position for locking; the breech body in the closing position and from the breech body locking position to the breech body release position, wherein the breech locking device has an electromagnet for moving the breech body lock from the breech body release position to the breech body locking position, or has an electromagnet for moving the breech body lock from the breech body locking position to the breech body release position, or has an electromagnet for moving the breech body lock from the breach body release position to the breech body locking position and for moving the breech body lock from the breech body locking position to the breech body release position.

2. The firearm as claimed in claim 1, wherein the breech locking device has an elastic element, in particular a spring, further in particular a coil compression spring or a coil pull-back spring.

3. The firearm as claimed in claim 1, wherein when the electromagnet is in a deenergized state, the breech body lock is arranged in the breech body release position.

4. The firearm as claimed in claim 1, wherein when the electromagnet is in an energized state, the breech body lock is in the breech body release position.

5. The firearm as claimed in claim 1, wherein the firearm also has a firing pin and the breech body lock has a locking section, wherein the locking section has a recess in which the firing pin is arranged to be movable reciprocally in the longitudinal direction of the barrel.

6. The firearm, in particular a firearm as claimed in claim 1, wherein the firearm has a firing device that has at least one electromagnet for at least partial actuation of same.

7. The firearm as claimed in claim 6, wherein the firing device has a firing pin that is movable from a neutral position to a firing position by means of the electromagnet.

8. The firearm as claimed in claim 6, wherein the firing pin or a section thereof is movable from the firing position to the neutral position by means of the electromagnet.

9. The firearm as claimed in claim 6, wherein the firing device has more than one electromagnet.

10. The firearm as claimed in claim 7, wherein the firing pin is of a multi-part form.

11. The firearm as claimed in claim 7, wherein the firing device has an elastic element.

12. The firearm as claimed in claim 6, wherein the firing device has three electromagnets.

13. The firearm as claimed in claim 7, wherein the firing pin comprises two pieces.

14. The firearm as claimed in claim 7, wherein the firing device has a spring.

* * * * *